US006098312A

United States Patent [19]

Tuggle

[11] Patent Number: 6,098,312

[45] Date of Patent: Aug. 8, 2000

[54] EXHAUST VENT ADAPTER FOR A CLOTHES DRYER

[75] Inventor: W. Gregory Tuggle, Spring Lake, Mich.

[73] Assignee: Builder's Best, Inc., Jacksonville, Tex.

[21] Appl. No.: 09/212,815

[22] Filed: Dec. 16, 1998

Related U.S. Application Data

[60] Provisional application No. 60/069,835, Dec. 16, 1997.

[51] Int. Cl.[7] ..... F26B 11/02

[52] U.S. Cl. ..... 34/607; 34/134; 34/235

[58] Field of Search ..... 34/601, 602, 604, 34/606, 607, 134, 235; 205/46, 192, 331; 454/347, 359

[56] References Cited

U.S. PATENT DOCUMENTS

| | | | |
|---|---|---|---|
| 409,631 | 8/1889 | Cooper . | |
| 1,278,894 | 9/1918 | Falk . | |
| 2,095,702 | 10/1937 | Johnson . | |
| 2,509,782 | 5/1950 | Person, Jr. . | |
| 4,348,818 | 9/1982 | Brown | 34/607 X |
| 4,380,126 | 4/1983 | Kinder | 34/607 X |
| 4,598,692 | 7/1986 | Hitch . | |
| 4,989,347 | 2/1991 | Kretchmen | 34/235 X |
| 5,121,948 | 6/1992 | Anderson et al. . | |
| 5,199,190 | 4/1993 | Mayer et al. . | |
| 5,584,129 | 12/1996 | Williamson | 34/606 X |
| 5,819,435 | 10/1998 | Tuggle . | |
| 5,860,224 | 1/1999 | Larson | 34/606 X |
| 5,970,623 | 10/1999 | Tuggle | 34/134 |
| B1 5,121,948 | 6/1992 | Anderson et al. . | |

*Primary Examiner*—Stephen Gravini
*Attorney, Agent, or Firm*—Rader, Fishman & Grauer PLLC

[57] ABSTRACT

An adapter for a clothes dryer provides for venting exhaust air from a drying chamber outlet within the clothes dryer cabinet to an exhaust opening in the cabinet wall. The adapter provides for alternative dryer vent exhaust locations without the need for custom cutting of the dryer vent conduits. The invention comprises an angled portion having two legs that are slidably adjustable in their lengths. The adapter can then be configured to fit any dryer cabinet regardless of the position of dryer chamber outlet relative to the exhaust opening.

16 Claims, 2 Drawing Sheets

EXHAUST VENT ADAPTER FOR A CLOTHES DRYER

This application claims the benefit of U.S. application Ser. No. 60/069,835 filed Dec. 16, 1997.

BACKGROUND OF THE INVENTION

1. Field of the Invention

The invention is directed to a vent for a clothes dryer; and, more particularly, to an exhaust vent adapter for use in venting dryer exhaust air through a preferred wall, selected from one of several alternative dryer exhaust vent exhaust locations.

2. Description of the Related Art

Contemporary clothes dryers are well known and generally comprise a cabinet typically defined by a front wall, rear wall, opposing sidewalls, top wall, and, optionally, a bottom wall. A control panel having electrical, mechanical, or electromechanical controls generally is provided at the junction of the top wall and the rear wall and controls the operation of the dryer. A drum for containing the clothes to be dried is rotatably mounted within the interior of the cabinet. Access is provided to the drum through a door in the cabinet front wall.

Heated air is either forced or drawn through the drum by a fan connected to the drum by a conduit. The air exhausted from the drum is generally passed through a lint trap where it is then exhausted through a vent to the atmosphere.

Traditionally, the dryer vent is a metal conduit with one end connected to the fan and the other end exiting the cabinet through the rear wall. It is becoming more common for the dryer vent to exit cabinet walls other than the rear wall, especially the sidewalls or the bottom wall. Punch-outs, or access panels, are often provided by the dryer manufacturer in the sidewalls or bottom wall for the alternate locations of the exhaust vent. However, dryer manufacturers still provide a fixed internal conduit which exits through the rear wall.

This fixed internal conduit is disadvantageous in that where an alternative exhaust vent exit is desired, the dryer installer must remove or alter the original exhaust vent, resulting in a custom installation that increases the time and expense of installing the dryer. This problem is exacerbated because different dryer manufacturers have different physical locations for the fan, internal conduits, and the punch-outs, prohibiting commonality between alternative installations for the different manufacturers. Heretofore, no single conduit replacement would work for all dryers.

One solution that has been adopted is to utilize a flexible metal conduit for the exhaust vent. The advantage of a flexible metal conduit is that it can be directed to any desired outlet in the dryer easily and without assembly. The disadvantages are that such installations lack durability and compromise safety. Flexible metal conduit is typically thin-walled aluminum that can be easily dented. If, for example, the dryer drum belt breaks, the spring-loaded idler arm that ordinarily maintains the belt in tension can be forcibly thrust upon the exhaust vent, thereby denting flexible conduit and requiring replacement of the exhaust vent. Moreover, flexible conduit is corrugated and prone to build up lint, which can interrupt airflow and be a fire hazard.

SUMMARY OF THE INVENTION

The invention overcomes the problems of the prior art by providing a durable exhaust vent adapter for a clothes dryer cabinet that can be easily adjusted to fit any combination of dryer chamber outlet and exhaust opening location, regardless of the cabinet wall selected for exiting the exhaust conduit. More particularly, the adapter of the invention has a first conduit leg and a second conduit leg connected to each other by an angled elbow. Normally, the elbow is a right angle elbow. Each conduit leg has a fixed portion and an adjustable portion so that the length of each leg can be selectively adjusted. The end of one of the legs is adapted to operatively connect to the dryer chamber outlet of a clothes dryer. Adjustments to the lengths of the respective legs will enable an installer to connect the dryer chamber outlet to an exhaust opening in the cabinet, regardless of the position of the exhaust opening in the cabinet relative to the dryer chamber outlet. Therefore, the custom installation required by selecting an alternative exhaust vent exit is quickly and simply solved by the adapter according to the invention, resulting in better installations and reduced costs for the end user.

Preferably, the fixed portion of each leg is a fixed conduit connected to the elbow, and the adjustable portion of each leg is a second conduit telescopically interfit with the fixed conduit. Visual indicia can be provided at each telescopic interfit connection by which the length of each leg can be automatically set to a predetermined length so as to fit a given dryer manufacturer's specifications. Also, smoother airflow can be provided when telescopic interconnections in the air stream comprise the male telescoping component being upstream from the female telescoping component.

BRIEF DESCRIPTION OF THE DRAWINGS

The invention will now be described with reference to the drawings in which.

DETAILED DESCRIPTION OF THE PREFERRED EMBODIMENTS

Figure 1:
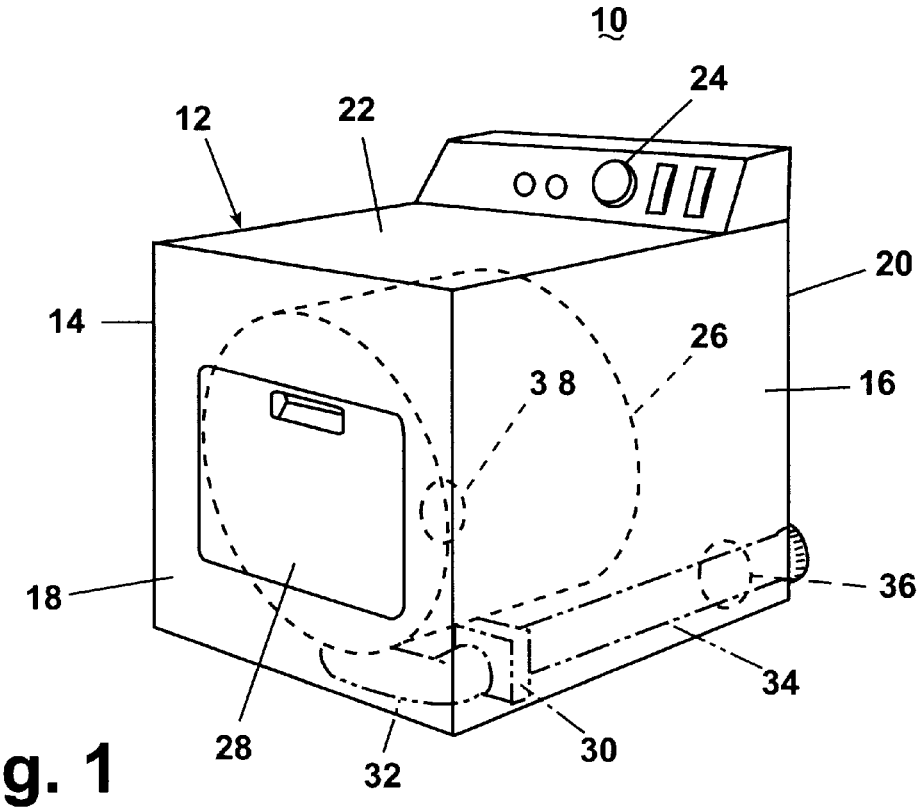
FIG. 1 is a perspective view of a clothes dryer illustrating the environment of the invention.

FIG. 1 discloses a contemporary clothes dryer 10 illustrating the environment of the invention. A brief discussion of the clothes dryer 10 will aid in the understanding of the invention. The clothes dryer 10 comprises a cabinet 12 having opposing sidewalls 14 and 16, front wall 18, rear wall 20, top wall 22, and, optionally, a bottom wall (not shown).

A control console 24 extends from the junction of the rear wall 20 and top wall 22. The control console typically includes electrical, mechanical, or a combination of electrical and mechanical controls. The controls permit the user to control the various drying cycles of a contemporary dryer. The location of the control console 24 can be at another location than is illustrated.

The cabinet 12 contains a rotatable drum 26 to which access is provided by a door 28, most often hingedly mounted to the front wall 18. The drum defines a drying chamber for receiving wet clothes to be dried and typically has an outlet for exhausting air from the drying chamber.

A dryer fan 30 is also provided within the cabinet 12. The inlet of the fan 30 is connected to the drying chamber outlet by an inlet conduit 32. An outlet of the fan 30 is connected to an outlet conduit 34, which typically passes through the rear wall 20. The outlet conduit 34 defines the exhaust vent through which heated exhaust air passing through the dryer is vented to the atmosphere.

In operation, a heater (not shown) is provided in the clothes dryer to heat air, which is pulled through the interior of the drum 26 by the fan 30 into the inlet conduit 32. It is common to provide a lint filter in the dryer airflow, preferably at the connection of the inlet conduit 32 with the drum 26. The air is then drawn by the fan 30 through the inlet conduit 32 and expelled through the outlet conduit 34, passing through the rear wall 20, to the atmosphere.

In most contemporary clothes dryers such as that illustrated in FIG. 1, original equipment manufacturers generally arrange the outlet conduit 34 to exit through the rear wall 20. It is also common to provide punch-outs or alternative exhaust outlets 36, 38 in the sidewalls 14, 16 respectively, for alternative venting locations of the outlet conduit 34. The punch-outs 36, 38 are shown near the junction of the sidewalls 14, 16 and rear wall 20, but can be at any desired location in the cabinet. Where there is a bottom wall in the cabinet there may be a corresponding punch-out (not shown) when it is desired to vent the dryer through the floor.

During installation of the dryer 10, where it is advantageous to vent exhaust air at a location other than the rear wall 20, the dryer 10 must be custom installed. Typically, this requires that the installer remove the original outlet conduit 34 and install a new outlet conduit that is sized and shaped to exit through one of the alternative venting locations, such as punch-outs 36 and 38 or the bottom wall.

The customization of the outlet conduit 34 is made more difficult in that not all original equipment manufacturers use the same locations for the fan 30 and alternative venting locations. Therefore, the new outlet conduit must be customized for each original equipment manufacturers' dryers. The increased customization results in increased costs to the dryer purchaser.

Figure 2:
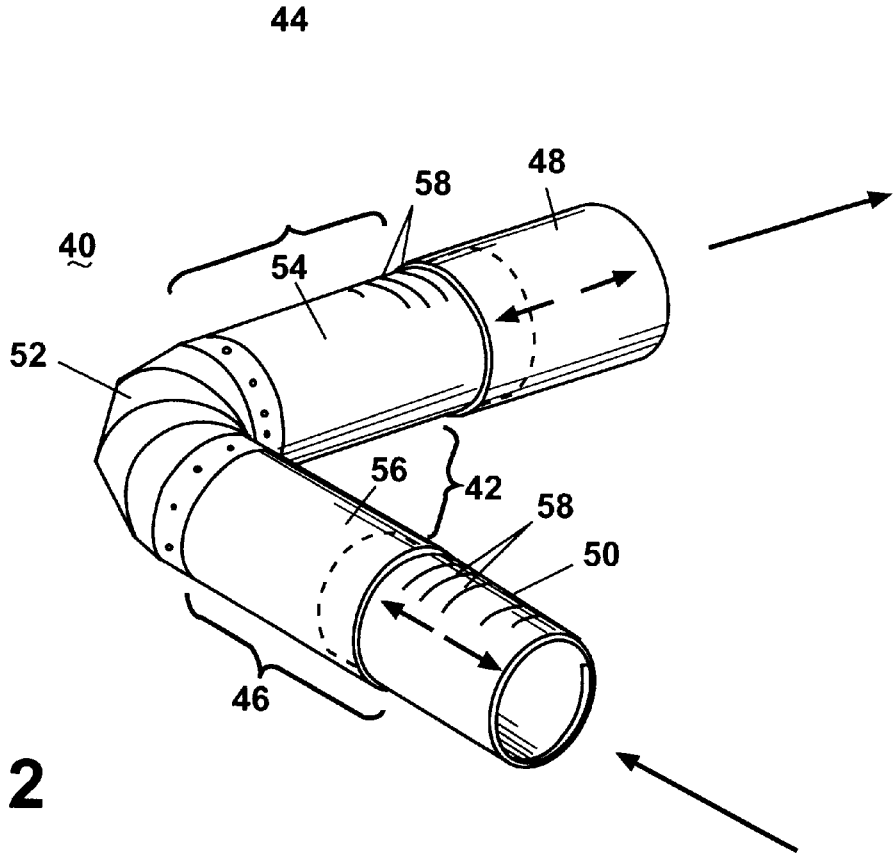
FIG. 2 is a perspective view illustrating the adapter according to the invention.

The invention, as illustrated in FIG. 2, overcomes the problems associated with the customization needed for alternative venting locations by providing an exhaust vent adapter 40 that is quickly and easily adapted to any arrangement of dryer chamber outlet and alternative exhaust opening locations. The adapter 40, according to the invention comprises an elbow 52 having first and second legs 44 and 46 extending therefrom. Each leg 44, 46 has a fixed portion and a respective adjustable portion or slide adjuster 48, 50 slidably mounted thereon. The slide adjusters effectively increase or decrease the length of the legs.

The elbow 52 is conventional, defining a right angle in the embodiment illustrated, and first and second conduits 54 and 56 are mounted to the ends of the elbow 52. The elbow can comprise multiple sections, which rotate relative to each other. The elbow 52, first conduit 54, and second conduit 56 are preferably made from sheet metal of the type common in the industry.

The slide adjusters 48 and 50 are also preferably made from sheet metal. One of the slide adjusters 48 and 50 is sized or adapted with an additional adapter to mount to the outlet of the fan 30 or directly to the dryer chamber outlet and the other slide adjuster is sized to pass through the punch-outs 36 and 38. For purposes of this description, the slide adjuster 50 is mated to the outlet of the fan 30 and slide adjuster 48 is sized to pass through the punch-outs 36, 38.

Since the slide adjuster 50 is sized to mount to the outlet of the fan 30, it is preferred that the slide adjuster 50 be slidably received within the interior of the second conduit 56 of the right angle portion 42. Although it is not a requirement that the slide adjuster 50 be slidably received within the second conduit 56, it is preferred so as to avoid the end of the second conduit facing the exhaust airflow, which could result in the build-up of lint along the end of the second conduit. For similar reasons, the slide adjuster 48 is preferably slideably mounted over the first conduit 54.

The installation of the adapter 40 will be described with reference to FIG. 3. Prior to installing to the adapter 40, the original outlet conduit 34 must be removed. After the original conduit 34 is removed, the installer determines the distance between the outlet of the fan 30' and the center of the punch-out 38' and sets the position of the slide adjuster 50 accordingly by sliding the slide adjuster 50 into the second conduit 56. Next, the installer determines the distance between the punch-out 38' and the center of the outlet of the fan 30' and sets the slide adjuster 48 accordingly by sliding the slide adjuster 48 over the first conduit 54. The installer can fix the positions of the slide adjusters 48 and 50 by tape, screws, bands, or other fasteners. The installer then mounts the slide adjuster 50 to the outlet of the fan 30 and passes the slide adjuster 48 through the punch-out 38' in whatever order is appropriate for the particular installation.

It should be noted that the slide adjusters 48 and 50 need not be fixed in their adjusted position prior to installation. In some installations, it may prove more useful to leave the slide adjusters 48 and 50 free to enable fine-tuning of the adapter once it is installed. Additionally, the first and second conduits 54, 56 and/or the slide adjusters 48, 50 can include indicia identifying the correct position of the slide adjusters 48 and 50 for one or more dryer configurations manufactured by the original equipment manufacturers. For the adapter 40, it is preferred that the indicia be at least one identified line 58 on the slide adjuster 50 and the first conduit 54. To set the position of the slide adjusters 48 and 50, the slide adjuster 50 need only be slid until the end of the second conduit 56 aligns with the correct identified line.

Figure 3:
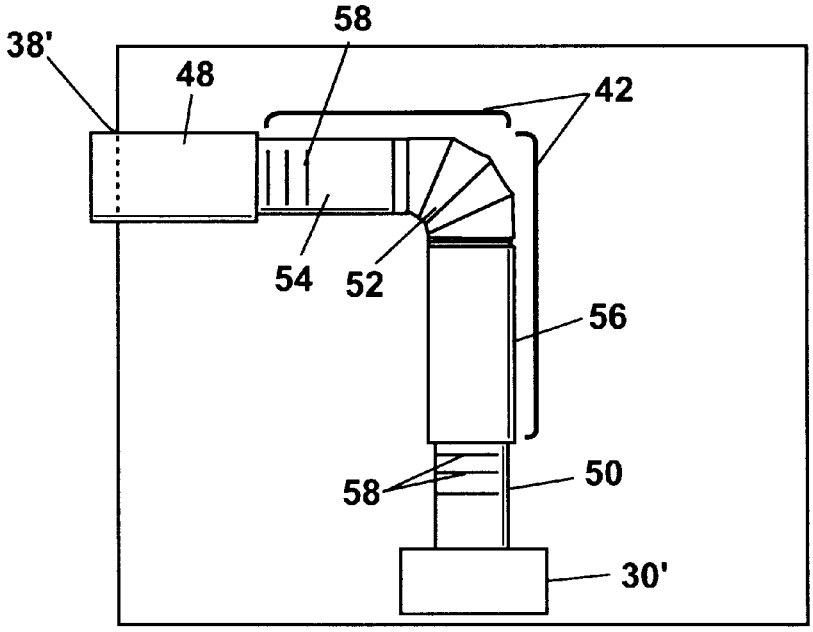
FIG. 3 is a schematic view illustrating a first possible installation of the adapter according to the invention.
Figure 4:
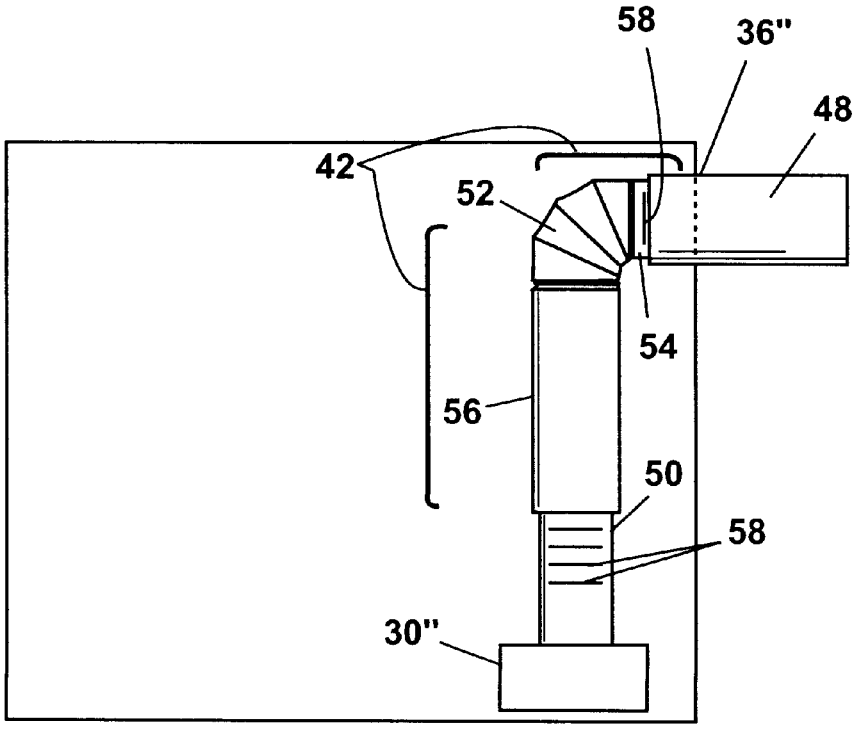
FIG. 4 is a second schematic view illustrating a second possible installation of the adapter according to the invention.

FIG. 4 illustrates the adapter 40 in a configuration where the fan 30 is closer to the sidewall 16 and the punch-out 36 is near the junction of the rear wall 20 and the sidewall 16. In this installation, the fan 30" is located closer to the sidewall, resulting in a decrease in the effective length of the conduit from the elbow to the punch-out 36 as compared to the installation shown in FIG. 3.

From the above description and the installations illustrated in FIGS. 3 and 4, it is clear that the invention provides a quick and easy solution to the problems associated with alternative dryer vent locations. The invention can easily be configured by merely sliding the slide adjusters 48 and 50 to fit any fan and punch-out configuration found in contemporary clothes dryers. Additionally, the use of indicia on the conduits and/or slide adjusters provides for the quick and accurate positioning of the slide adjusters 48 and 50. Therefore, the adapter 40 is a great advance and improvement over the prior art where alternative dryer vent locations require custom cutting of each conduit on the job site during installation. It should be noted that although the adapter preferably has a right angle geometry, it is within the scope of the invention for other angles, greater than or less than 90°. To accomplish other angles, the elbow can be replaced with another elbow having a different angle. Moreover, it is within the scope of the invention to provide alternative adjustable portions such as flexible conduits attached to the ends of the fixed portions. The elbow and fixed portions will provide rigidity and strength for durability and the flexible portions provide adjustability at the ends of the rigid central portion of the adapter.

While particular embodiments of the invention have been shown, it will be understood, of course, that the invention is not limited thereto since modifications may be made by those skilled in the art, particularly in light of the foregoing teachings. Reasonable variation and modification are possible within the scope of the foregoing disclosure of the invention without departing from the spirit of the invention.

What is claimed is:

1. An adapter for venting exhaust air within a clothes dryer cabinet of the type having a drying chamber outlet and multiple exterior walls, including opposing sidewalls and a rear wall, with at least one of said walls other than the rear wall having an exhaust opening therethrough, the adapter comprising:

a first conduit leg and a second conduit leg connected to each other by an angled conduit elbow, each conduit leg having a fixed portion and an adjustable portion wherein the length of each conduit leg is selectively adjustable, and each conduit leg having a terminal end distal from the conduit elbow, the first conduit leg terminal end being adapted to operatively connect to a drying chamber outlet in fluid communication, wherein the adapter can vent exhaust air from a clothes dryer cabinet through the exhaust opening regardless of the position of the drying chamber outlet relative to the exhaust opening when the first conduit leg terminal end is connected to the drying chamber outlet and the length of each leg is adjusted so that the second conduit leg terminal end effectively projects through the opening.

2. An adapter according to claim 1 wherein at least one of the fixed portions is a first conduit extending from the elbow and the respective adjustable portion is a second conduit telescopically interfit with the first conduit.

3. An adapter according to claim 2 wherein each of the fixed portions is a first conduit extending from the elbow and the respective adjustable portion is a second conduit telescopically interfit with the first conduit.

4. An adapter according to claim 3 wherein the terminal end is on each second conduit.

5. An adapter according to claim 4 wherein one of the first and second conduits has a visual indicium that references a predetermined length of the respective leg and the other of the first and second conduits has a marker that when aligned with the visual indicium will automatically establish the predetermined length.

6. An adapter according to claim 5 wherein the elbow is a right angle.

7. An adapter according to claim 6 wherein the second conduit on the first conduit leg is smaller than the respective first conduit to telescopically fit within the first conduit, and the second conduit on the second conduit leg is larger than the respective first conduit to telescopically fit over the first conduit, so that when the first conduit leg is operatively connected to the dryer chamber outlet, the telescopic interfit connections do not present obstacles to air flow through the adapter.

8. An adapter according to claim 3 wherein the second conduit on the first conduit leg is smaller than the respective first conduit to telescopically fit within the first conduit, and the second conduit on the second conduit leg is larger than the respective first conduit to telescopically fit over the first conduit, so that when the first conduit leg is operatively connected to the dryer chamber outlet, the telescopic interfit connections do not present obstacles to air flow through the adapter.

9. In a clothes dryer cabinet of the type having a drying chamber with an outlet and multiple exterior walls, including opposing sidewalls and a rear wall, with at least one of said walls other than the rear wall having an exhaust opening therethrough, and an adapter to fluidly communicate between the drying chamber outlet and the exhaust opening, the improvement wherein the adapter comprises a first conduit leg and a second conduit leg connected to each other by an angled conduit elbow, each conduit leg having a fixed portion and an adjustable portion wherein the length of each conduit leg is selectively adjustable, and each conduit leg having a terminal end distal from the conduit elbow, the first conduit leg terminal end being operatively connected to the drying chamber outlet in fluid communication, so that the adapter can vent exhaust air from the clothes dryer cabinet through the exhaust opening regardless of the position of the drying chamber outlet relative to the exhaust opening when the length of each leg is adjusted so that the second conduit leg terminal end effectively projects through the exhaust opening.

10. An adapter according to claim 9 wherein at least one of the fixed portions is a first conduit extending from the elbow and the respective adjustable portion is a second conduit telescopically interfit with the first conduit.

11. An adapter according to claim 10 wherein each of the fixed portions is a first conduit extending from the elbow and the respective adjustable portion is a second conduit telescopically interfit with the first conduit.

12. An adapter according to claim 11 wherein the terminal end is on each second conduit.

13. An adapter according to claim 12 wherein one of the first and second conduits has a visual indicium that references a predetermined length of the respective leg and the other of the first and second conduits has a marker that when aligned with the visual indicium will automatically establish the predetermined length.

14. An adapter according to claim 13 wherein the elbow is a right angle.

15. An adapter according to claim 14 wherein the second conduit on the first conduit leg is smaller than the respective first conduit to telescopically fit within the first conduit, and the second conduit on the second conduit leg is larger than the respective first conduit to telescopically fit over the first conduit, so that when the first conduit leg is operatively connected to the dryer chamber outlet, the telescopic interfit connections do not present obstacles to air flow through the adapter.

16. An adapter according to claim 11 wherein the second conduit on the first conduit leg is smaller than the respective first conduit to telescopically fit within the first conduit, and the second conduit on the second conduit leg is larger than the respective first conduit to telescopically fit over the first conduit, so that when the first conduit leg is operatively connected to the dryer chamber outlet, the telescopic interfit connections do not present obstacles to air flow through the adapter.

* * * * *

UNITED STATES PATENT AND TRADEMARK OFFICE

CERTIFICATE OF CORRECTION

PATENT NO. : 6,098,312

DATED : August 8, 2000

INVENTOR(S) : W. Gregory Tuggle

It is certified that error appears in the above-identified patent and that said Letters Patent is hereby corrected as shown below:

Claim 9, column 6, line 4, delete "cabinet"

Claim 10, column 6, line 26 "An Adapter" should read --A clothes dryer--

Claim 11, column 6, line 30 "An Adapter" should read --A clothes dryer--

Claim 12, column 6, line 34 "An Adapter" should read --A clothes dryer--

UNITED STATES PATENT AND TRADEMARK OFFICE

CERTIFICATE OF CORRECTION

PATENT NO. : 6,098,312

DATED : August 8, 2000

INVENTOR(S) : W. Gregory Tuggle

It is certified that error appears in the above-identified patent and that said Letters Patent is hereby corrected as shown below:

Claim 13, column 6, line 36 "An Adapter" should read --A clothes dryer--

Claim 14, column 6, line 42 "An Adapter" should read --A clothes dryer--

Claim 15, column 6, line 44 "An Adapter" should read --A clothes dryer--

Claim 16, column 6, line 53 "An Adapter" should read --A clothes dryer--

Signed and Sealed this

Nineteenth Day of December, 2000

*Attest:*

Q. TODD DICKINSON

*Attesting Officer*

*Commissioner of Patents and Trademarks*